US006607015B1

(12) United States Patent
Chen

(10) Patent No.: US 6,607,015 B1
(45) Date of Patent: Aug. 19, 2003

(54) FOLDABLE WORKTABLE

(75) Inventor: Ruey-Zon Chen, Tali (TW)

(73) Assignee: Rexon Industrial Corp., Ltd., Taichung Hsien (TW)

( * ) Notice: Subject to any disclaimer, the term of this patent is extended or adjusted under 35 U.S.C. 154(b) by 0 days.

(21) Appl. No.: 10/141,005

(22) Filed: May 9, 2002

(51) Int. Cl.[7] ..... B25H 1/00
(52) U.S. Cl. ..... 144/286.1; 108/132
(58) Field of Search ..... 144/286.1, 286.5, 144/287, 285, 1.1; 108/131, 132; 182/180.3; D6/396; 248/188; 24/311, 319, 343, 376, 454, 600.1; 269/289 R

(56) References Cited

U.S. PATENT DOCUMENTS 161,304 A * 3/1875 Waggoner ..... 108/131
208,912 A * 10/1878 Lambie ..... 108/131
5,257,839 A * 11/1993 Nielsen et al. ..... 292/113
6,000,345 A * 12/1999 Gillotti ..... 108/36
6,041,721 A * 3/2000 Weston ..... 108/65

* cited by examiner

*Primary Examiner*—Allen Ostrager
*Assistant Examiner*—Shelley Self
(74) *Attorney, Agent, or Firm*—Venable LLP; Fei-Fei Chao

(57) ABSTRACT

A foldable worktable includes a tabletop and two H-shaped legs pivotally attached to a bottom of the tabletop to support the tabletop during use. Each leg has a first attachment member attached to hold the tabletop and the two legs in place to make the worktable stable when in use or folded.

1 Claim, 4 Drawing Sheets

FOLDABLE WORKTABLE

BACKGROUND OF THE INVENTION

1. Field of the Invention

The present invention relates to a worktable, and more particularly to a foldable worktable.

2. Description of Related Art

A conventional worktable usually has a tabletop and at lease three legs securely attached to the bottom of the tabletop to support the tabletop. An electrical tool, such as a table saw, is mounted on the worktable for easy operation. However, the article usually must be finished in a different place. The fixed worktable is difficult to move. Consequently, a foldable worktable is available in the market. The conventional foldable worktable solves the problem of moving the table. However, the conventional foldable worktable needs a precise attachment member to maintain the stability of the worktable during use.

The present invention has arisen to mitigate and/or obviate the disadvantages of the conventional foldable worktable.

SUMMARY OF THE INVENTION

The main objective of the present invention is to provide an improved foldable worktable.

To achieve the objective, the foldable worktable in accordance with the present invention comprises a tabletop and two H-shaped legs pivotally mounted on the bottom of the tabletop to support the tabletop during use. A first attachment member is attached to each foot to hold the tabletop and the two legs in place during use or when the table is folded.

Further benefits and advantages of the present invention will become apparent after a careful reading of the detailed description with appropriate reference to the accompanying drawings.

DETAILED DESCRIPTION OF THE INVENTION

Figure 1:
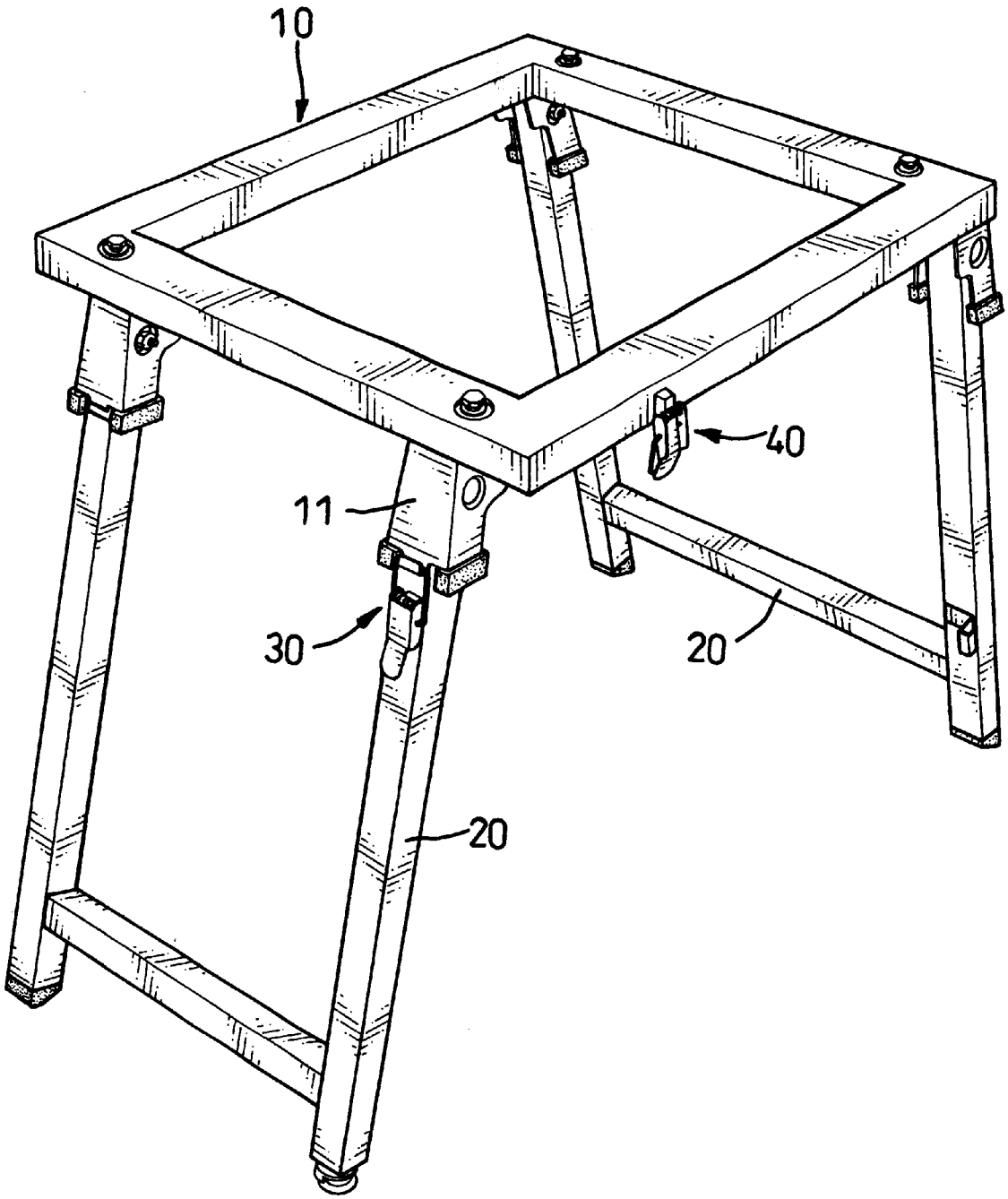
FIG. 1 is a perspective view of a foldable worktable in accordance with the present invention.
Figure 2:
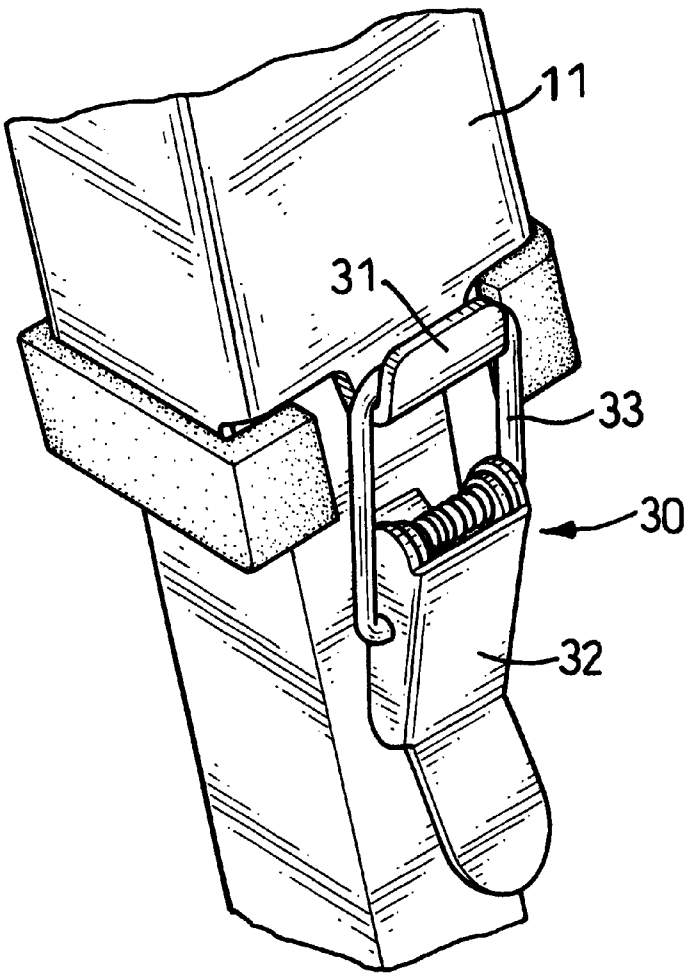
FIG. 2 is a perspective view of an attachment member of the foldable worktable in FIG. 1.

With reference to the drawings and initially to FIGS. 1 and 2, a foldable worktable in accordance with the present invention comprises a tabletop (10) and two H-shaped legs (20). The tabletop (10) has a top surface and a bottom surface. The H-shaped legs (20) are pivotally attached to the bottom surface of the tabletop (10) to support the tabletop (10) during use. A first attachment member (30) is attached to each leg (20) to hold the tabletop (10) and the two legs (20) in place during use.

In the preferred embodiment of the present invention, the tabletop (10) is a frame. The tabletop (10) has a first side and a second side opposite to the first side of the tabletop (10). Each of the first side and the second side of the tabletop (10) includes two opposite ends each having a bracket (11) extending downwardly from the tabletop (10).

Each H-shaped leg (20) is pivotally attached to a corresponding one of the first side and the second side of the tabletop (10). Each H-shaped leg (20) has two upper ends. Each end is respectively pivotally mounted in one of two brackets (11) of the corresponding one of the first side and the second side of the tabletop (10).

The first attachment member (30) includes a hook (31) formed on a bottom of each of the brackets (11). A lever (32) is pivotally mounted on one side of each of the legs (20) and corresponds to the hook (31). A U-shaped loop (33) is pivotally attached to the lever (32) and selectively mounted over the hook (31). The loop (33) has two opposite ends respectively pivotally attached to opposite sides of the lever (32).

Figure 3:
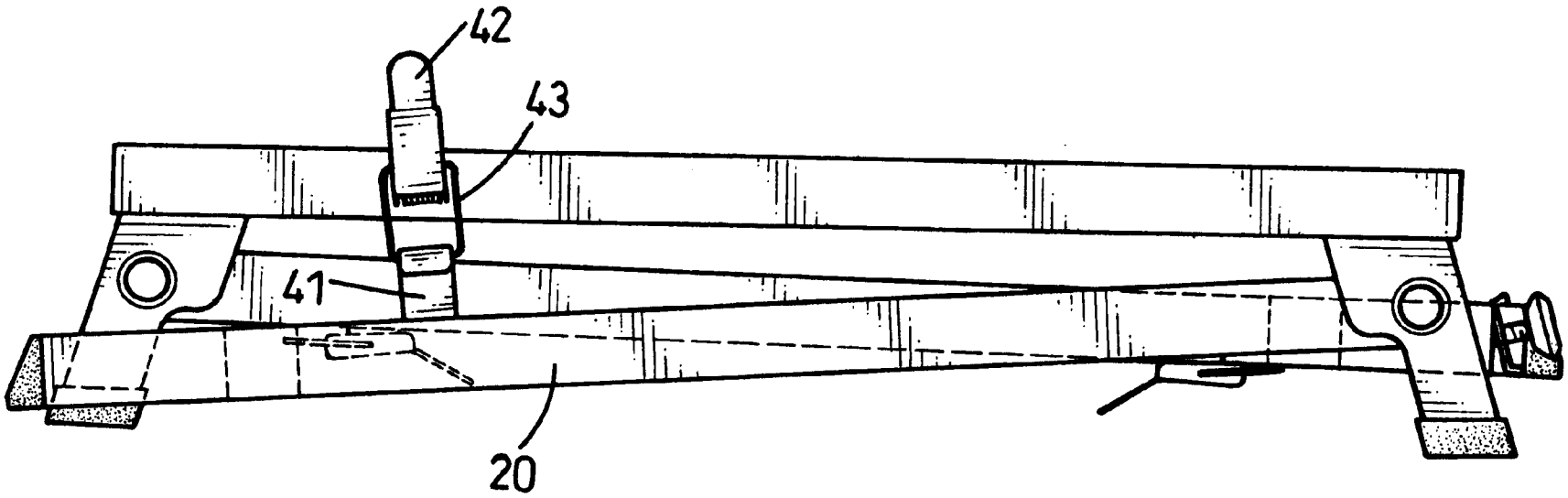
FIG. 3 is a side plan view of the foldable worktable in FIG. 1 when folded.

With reference to FIGS. 1, 2 and 3, the foldable worktable includes a second attachment member (40) to hold the two legs (20) in place when the foldable worktable of the present invention is folded. The second attachment member (40) is the same as the first attachment member (30) and includes a hook (41) securely attached to an inner side of one of the two legs (20). A lever (42) is pivotally mounted on a third side of the tabletop (10) and corresponds to the hook (41) of the second attachment member (40). The third side of the tabletop (10) has two opposite ends connected to the first side and the second side of the tabletop (10). A loop (43) is pivotally mounted on the lever (42) and selectively mounted on the hook (41) of the second attachment member (40).

To operate the foldable worktable, each leg (20) is pressed against an inner side of the bracket (11), and the lever (32) of the first attachment member is lifted up to position the loop (33) (30) within the hook (31). The lever (32) is pulled downward to pull the loop (33) securely into the hook (31) to hold the two legs (20) in place on the tabletop (10).

With reference to FIG. 3, the foldable worktable is folded by first folding the leg (20) without a second attachment member (40) hook (41) against the bottom of the tabletop (10). Then the leg (20) with the hook (41) is folded to abut the other leg (20) that abuts the bottom of the tabletop (10). The lever (42) of the second attachment member (40) is pulled downward to position a top of the loop (33) within the hook (41). The lever (42) of the second attachment member (40) is pivoted upward to pull the loop (43) securely into the hook (41) to hold the two legs (20) in place against the tabletop (10) when the foldable worktable is folded.

Figure 4:
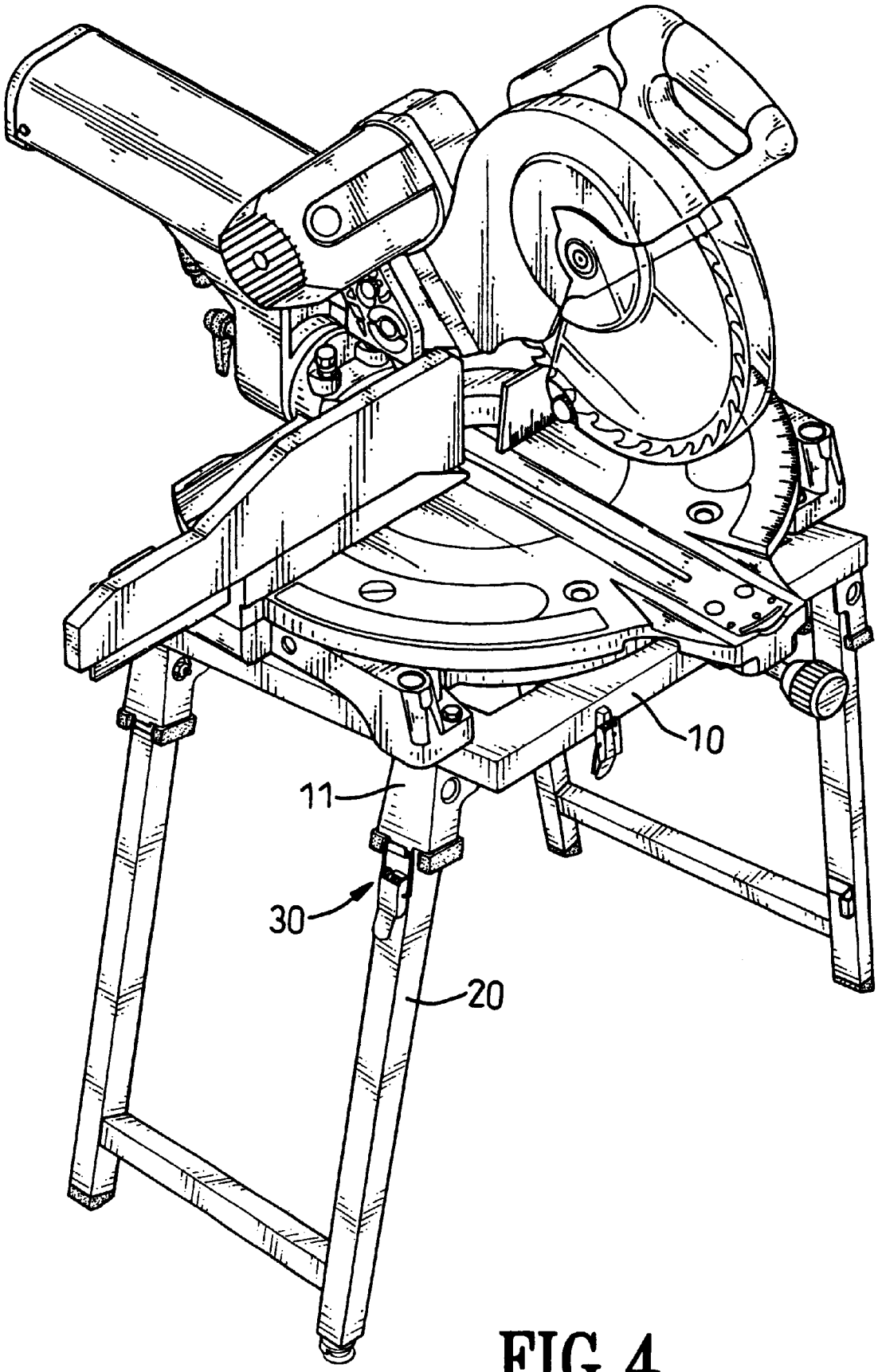
FIG. 4 is an operational perspective view of the foldable table in FIG. 1.

With reference to FIG. 4, the foldable worktable is adapted to support an electric tool, such as a radial arm saw.

As described above, the foldable worktable is a stable worktable when its extended during us or folded for transportation and mitigates and/or obviates the disadvantages of the conventional foldable worktable.

Although the invention has been explained in relation to its preferred embodiment, it is to be understood that many other possible modifications and variations can be made without departing from the spirit and scope of the invention as hereinafter claimed.

What is claimed is:

1. A foldable worktable comprising:

a tabletop including a first side and a second side opposite to the first side of the tabletop, each of the first side and the second side of the tabletop including two opposite ends each having a bracket extending downward from the tabletop;

two H-shaped legs each pivotally attached to a corresponding one of the first side and the second side of the tabletop and having two upper ends respectively pivotally mounted in two brackets of the corresponding one of the first side and the second side of the tabletop;

a first attachment member pivotally mounted on each H-shaped leg and connected to a corresponding one of the brackets on the first side and the second side of the tabletop, the first attachment member including:

a hook formed on a bottom of each of the corresponding brackets;

a lever pivotally attached to one side of each of the legs and corresponding to the hook;

a U-shaped loop pivotally attached to the lever and selectively connected to the hook, the U-shaped loop having two opposite ends respectively pivotally connected to opposite sides of the lever; and a second attachment member comprising a hook securely attached to an inner side of one of the two legs, a lever pivotally attached to a third side of the tabletop and corresponding to the hook of the second attachment member, the third side of the tabletop having two opposite ends connected to the first side and the second side of the tabletop, and a loop pivotally attached to the lever of the second attachment and selectively connected to the hook of the second attachment member, whereby the second attachment member holds the two H-shaped legs in place when the worktable is folded.

* * * * *